United States Patent [19]

MacPhail et al.

[11] Patent Number: 4,719,023

[45] Date of Patent: Jan. 12, 1988

[54] GREASE COMPOSITION

[75] Inventors: Alexander C. B. MacPhail, Little Sutton; Henry Rutherford, Doddleston Chester, both of United Kingdom

[73] Assignee: Shell Oil Company, Houston, Tex.

[21] Appl. No.: 940,384

[22] Filed: Dec. 10, 1986

[51] Int. Cl.[4] ..... C10M 129/50; C10M 129/54

[52] U.S. Cl. ..... 252/39; 252/18; 252/41

[58] Field of Search ..... 252/39

[56] References Cited

U.S. PATENT DOCUMENTS

| | | | |
|---|---|---|---|
| 2,951,808 | 9/1960 | Norton et al. | 252/39 |
| 3,704,315 | 11/1972 | Strang | 252/39 |
| 3,711,407 | 1/1973 | Plumstead | 252/39 |
| 3,761,404 | 9/1973 | Calow et al. | 252/39 |
| 4,539,126 | 9/1985 | Bleeker et al. | 252/39 |
| 4,627,928 | 12/1986 | Karn | 252/39 |

FOREIGN PATENT DOCUMENTS 84910 3/1983 European Pat. Off. .

*Primary Examiner*—Ferris H. Lander
*Assistant Examiner*—Ellen McAvoy
*Attorney, Agent, or Firm*—Kimbley L. Muller

[57] ABSTRACT

A grease composition is disclosed comprising a base fluid, a thickening agent, overbased calcium alkyl salicylate and overbased magnesium alkyl salicylate.

4 Claims, No Drawings

GREASE COMPOSITION

FIELD OF THE INVENTION

The present invention relates to a grease composition which contains a base fluid and a thickening agent, and is free from potentially hazardous additives.

Grease compositions are generally used in environments where water, in minute or substantial quantity, is present. While the compositions provide lubrication they may fail to protect the metal parts with which they are in contact, from rust formation. Required are grease compositions that provide excellent lubrication and inhibit rust formation. To achieve this goal it has been proposed to add anti-rust additives to the grease composition. Particularly effective in this regard is sodium nitrite. Although this compound adds slightly to the oxididation stability of the composition, an antioxidant is included as well. Suitable and effective antioxidants are amines and products derived from amines.

BACKGROUND OF THE INVENTION

It is known that a combination of nitrites and amines may produce nitrosamines, some of which are believed to be carcinogenic. This problem is acknowledged by the persons skilled in the art and efforts have been undertaken to prevent the formation of nitrosamines. For example, in U.S. Pat. No. 4,200,542 it is described that the inhibition of nitrosamine formation can be obtained by adding to the grease composition a combination of an ascorbate or iso-ascorbate with alpha tocopherol. Although the latter combination is claimed to be effective, it is evident that only grease compositions that do not contain nitrites and/or amine derivatives can adequately solve the problem of nitrosamine formation.

European Patent Application No., 0084910, Application No. 832000772 filed Jan. 18, 1983 discloses a grease composition containing lithium salts of carboxy monoacids and diacids. The Li-greases may contain Ca or Mg alkyl salicylate, which salicylate may be either neutral or overbased.

DETAILED DESCRIPTION OF THE INVENTION

Applicants have surprisingly found that calcium alkyl salicylate when added to a grease composition shows excellent anti-rust properties, so that addition of sodium nitrite is no longer required. However, the dropping point of the grease composition, i.e. the temperature at which the grease passes from a semi-solid to a liquid phase, is lowered by the addition of calcium alkyl salicylate. It has now surprisingly been found that grease compositions containing a combination of calcium alkyl salicylate and magnesium alkyl salicylate shown excellent anti-rust properties and have satisfactory dropping points.

Accordingly, the present invention provides a grease composition comprising a base fluid, a thickening agent, calcium alkyl salicylate and magnesium alkyl salicylate. It appears that grease compositions according to the invention not only have excellent anti-rust properties and satisfactory dropping points, but also water washout characteristics which are superior to sodium nitrite-containing grease compositions.

The base fluid can be any lubricating agent known in the art. This includes mineral hydrocarbon oils, synthetic hydrocarbon oils, polymeric compounds such as polyolefins and polyglycols, esters such as dialkylsebacate, polysiloxanes, phenoxy phenyl ethers, and other lubricants, or mixtures thereof. Preferred are mineral and synthetic hydrocarbon oils. These oils may have been subjected to certain treatments, in particular a hydrotreatment. Suitably the viscosity of the lubricating agent is between 2 and 60 $mm^2/s$ at 100° C., preferably between 3 and 50 $mm^2/s$ at this temperature.

Thickening agents can be selected from a wide range of compounds which include substituted ureas, phthalocyanines, clays modified by treatment with a surface-active agent, which clays can be chosen from for example montmorillonites, in particular bentonite or attapulgite, zeolites or other complex inorganic silicates which occur naturally. Preferably the thickening agent is selected from alkali and alkaline earth metal soaps of fatty acids having from 6 to 30 carbon atoms. The metal salts applied in the soap are preferably lithium and/or calcium salts. When alkali metal and alkaline earth metal salts are used in combination the weight ratio of alkali metal: alkaline earth metal is suitably from 1:2 to 20:1. Suitable fatty acids are stearic acid, hydroxystearic acid, oleic acid, palmitic acid, myristic acid or hydrogenated castor oil fatty acid. These soaps may be used in combination with an alkali metal salt, in particular lithium salt, selected from the di alkali metal salt of $C_{4-12}$ aliphatic dicarboxylic acid, the alkali metal salt of aromatic hydroxy carboxylic acids and alkali metal salts of boric acids, such as lithium metaborate, lithium tetraborate, lithium perborate or the monolithium salt of orthoboric acid or with phosphate, phosphite or thiophosphate esters.

The alkly salicylates may be neutral calcium and magnesium salts. Preferably, at least one of the alkyl salicylates is overbased; particularly preferred is the case when both alkyl salicylates are overbased. The preparation of overbased metal alkyl salicylates is known in the art. A suitable method is described in UK Patent Application No. 2,097,417. The overbased metal alkyl salicylates are usually complexes of the metal hydroxide and/or carbonate and alkyl salicylate. The degree of overbasing is expressed as the basicity index (BI) defined as the equivalent ratio of metal: alkyl salicylic acid. The calcium alkyl salicylate suitably has a basicity index of from 1 to 15, and the magnesium alkyl salicylate has preferably a basicity index of from 1 to 8. The advantage of using overbased alkyl salicylates resides in that they now can neutralize acid compounds which may be formed when the grease composition is actually being used, so that a corrosive attack of metal parts by these acid compounds is prevented.

The length of the alkyl chain of the alkyl salicylate plays an important role in the uniformity of the distribution thereof in the grease composition. Generally, the chain length may vary between 5 and 50 carbon atoms, preferably from 10 to 35 carbon atoms. The chains may be branched, but suitably are straight. The amount of calcium alkyl salicylate is preferably between 0.1 and 10%w, in particular between 0.5 and 5%w, and the amount of magnesium alkyl salicylate is suitably from 0.05 to 5, in particular from 0.1 to 3%w, all percentages being based on the weight of the total composition.

The composition according to the invention may further contain several other compounds and additives. These include alcohols like glycol, glycerol, trimethylolpropane, pentaerythritol; linseed or castor oil; antiwear and extreme pressure additives such as triphenylphosphorothionate, zinc dialkyl dithio phosphate, lead naphthenate or sulphurized fatty oils; antioxidants such as diaryl amines, e.g. diphenylamines phenyl-naphthylamines, or alkylated derivatives thereof and other conventional additives.

The composition can be prepared by any of the techniques known in the art to be useful for the preparation of greases. For the preparation of a soap-containing grease these techniques include processes in which the desired acid or acids are incorporated in a suitable base fluid, e.g. a mineral base stock oil, and the resulting mixture is neutralized with suitable alkali metal or alkaline earth metal compounds, and also processes in which the desired soap is prepared separately and thereafter is incorporated in the base fluid. The alkyl salicylates are suitably mixed with the composition obtained, i.e. a mixture of the soap and the base fluid. Another suitable method for preparing the composition according to the invention comprises saponifying an ester from which the suitable fatty acid is to be obtained in the presence of alkali or alkaline earth metal compounds and of base fluid at elevated temperature, dehydrating the mixture obtained, adding additional base fluid to the dehydrated mixture and cooling the grease obtained. The metal alkyl salicylates are suitably mixed with the grease composition during the cooling stage. The preparations can be carried out batchwise or in a continuous manner.

The invention is illustrated by means of the following Examples.

EXAMPLE 1

To show the effect of calcium and magnesium alkyl salicylates on the dropping point and anti-rust properties of a grease composition a number of greases were prepared having various amounts of calcium alkyl salicylate and magnesium alkyl salicylate.

The base grease composition tested comprised 11.0%w of the lithium and calcium soaps of hydrogenated castor oil fatty acid, with a Li: Ca weight ratio of 6; 4.5%w of a package of conventional anti-oxidant, anti-corrosion and extreme pressure/anti-wear additives. 84.5%w mineral hydrocarbon oil having a viscosity of 100 $mm^2/s/40°$ C. and a viscosity index of 90.

To this base grease overbased calcium $C_{14-18}$ alkylsalicylate (Ca-AS) having a BI of 3.0 and overbased magnesium $C_{14-18}$ alkyl salicylate (Mg-AS) having a BI of 7.5 were added in amounts as indicated in Table I. The weight percentages are based on the weight of the above base grease composition.

The compositions were subjected to a dropping point test (IP 132) an and anti-rust test (IP 220, using salt water). The rating of the latter test ranges from 0 (=no rust) to 5(=rusty areas covering more than 10% of the surface). The results are shown in Table I.

TABLE 1

| Composition No. | Ca—AS % w | Mg—AS % w | Dropping Point (IP 132), °C. | Anti-rust (IP 220) |
|---|---|---|---|---|
| 1 | — | — | 198 | 5 |
| 2 | 2 | — | 179 | 2 |
| 3 | 3 | — | 177 | 0 |
| 4 | 2 | 1 | 188 | 2 |
| 5 | 3 | 1 | 187 | 0 |

From the results it is apparent that Ca-AS improves the anti-rust properties considerably and that the co-addition of Mg-AS effectively counteracts a dropping point decrease caused by the addition of Ca-AS.

EXAMPLE 2

In this Example grease compositions containing sodium nitrite and Ca-AS and Mg AS are compared.

Grease composition 6 contained
11.0%w hydrogenated castor oil fatty acid
1.6%w lithium hydroxide monohydrate
2.0%w sodium nitrite
5.3%w of a package of conventional anti-oxidant and extreme pressure/anti-wear additives,
80.1%w hydrocarbon oil used in Example 1.

Grease composition 7 contained
12.0%w hydrogenated castor oil fatty acid
1.5%w lithium hydroxide monohydrate
0.2%w calcium hydroxide
4.3%w of a package of conventional anti-oxidant, anti-corrosion and extreme pressure/anti-wear additives.
3.0%w Ca-AS, as used in Example 1
1.0%w Mg-AS, as used in Example, and
78.0%w hydrocarbon oil used in Example 1

A number of characteristics of the compositions was determined. These are indicated in Table II.

TABLE 2

| Composition No. | 6 | 7 |
|---|---|---|
| Penetration unworked/worked (IP 50), dmm | 239/243 | 238/248 |
| Dropping point (IP 132), °C. | 186 | 185 |
| Water wash-out (ASTM D 1264), % w | 50 | 1.3 |
| Anti-rust (ASTM D1743), rating | 1 | 1 |
| Copper corrosion (IP 112) | slight tarnish | Negative |
| Oil separation (IP 121) 18 hr/7d, % w | 0.41/1.68 | 0.39/1.72 |
| Roll test (ASTM D1831, modified such that penentration difference is determined after 100 h): | | |
| at ambient temperature, dmm | 112 | 29 |
| at 100° C., dmm | 122 | 94 |

From the above results it is apparent that the grease composition according to the present invention has similar or better characteristics than the prior art composition. In particular, the water resistance is improved considerably.

What we claim as our invention is:

1. A grease composition comprising a base fluid, a thickening agent and from 0.1 to 10.0 percent weight of an over-based calcium alkyl salicylate based on the weight of the total grease composition having a basicity of from 1 to 15, wherein said alkyl moiety has from 5 to 50 carbon atoms and from 0.05 to 5.0 weight percent of an over-based magnesium alkyl salicylate based on the weight of the total grease composition having a basicity index of from 1 to 8, wherein said alkyl moiety has from 5 to 50 carbon atoms.

2. The grease composition according to claim 1, in which said base fluid is a mineral or synthetic hydrocarbon oil.

3. The grease composition according to claim 1, in which the thickening agent is an alkali or alkaline earth metal soap of a fatty acid having from 9 to 30 carbon atoms per molecule.

4. The grease composition according to claim 3 in which said fatty acid is a hydrogenated castor oil.

* * * * *